US005990846A

United States Patent [19]

Dichter

[11] Patent Number: 5,990,846

[45] Date of Patent: Nov. 23, 1999

[54] SELF-ALIGNING GLOBAL POSITIONING SYSTEM ANTENNA

[75] Inventor: Carl R. Dichter, Chandler, Ariz.

[73] Assignee: Intel Corporation, Santa Clara, Calif.

[21] Appl. No.: 09/086,097

[22] Filed: May 28, 1998

[51] Int. Cl.[6] ..... H01Q 1/24; H01Q 1/42

[52] U.S. Cl. ..... 343/872; 343/702; 343/711

[58] Field of Search ..... 343/702, 872, 343/709, 700 MS, 713, 711, 712; H01Q 1/24, 1/38

[56] References Cited

U.S. PATENT DOCUMENTS 3,725,887 4/1973 Sneider ..... 340/224

5,406,294 4/1995 Silvey et al. ..... 343/709

5,606,732 2/1997 Vignone, Sr. ..... 343/702

*Primary Examiner*—Hoanganh Le

*Attorney, Agent, or Firm*—Trop, Pruner, Hu & Miles, P.C.

[57] ABSTRACT

A self-aligning global positioning system (GPS) antenna aligns with the earth's surface so as to maintain the integrity of the GPS tracking signal received by a GPS receiver. The antenna element may be maintained within a sealed container which floats inside a spherical reservoir filled with liquid. As a result, the GPS antenna moves along the inside surface of the spherical reservoir in a buoyant arrangement which self-levels the active element of the antenna with the earth's surface.

14 Claims, 2 Drawing Sheets

SELF-ALIGNING GLOBAL POSITIONING SYSTEM ANTENNA

BACKGROUND

This invention relates generally to global positioning system (GPS) antennas.

The widespread availability of low cost GPS receivers has spawned a myriad of GPS applications. GPS receivers are used for example by boaters to determine their position. Hikers can carry hand-held GPS receivers to locate themselves. In addition, GPS receivers for vehicle navigation are also available in personal and commercial vehicles. The GPS receiver may work with mapping software to indicate the user's position on a computer displayed map.

In order for the GPS receiver to work adequately, its active element antenna must be oriented in alignment with the earth's surface. That is, the active element should be parallel to the earth's surface when the GPS receiver is operational. With a hand-held unit, the user can simply orient the antenna in parallel alignment with the earth's surface.

However, in many other applications, it is not always practical to realign the antenna with respect to the earth's surface. For example, in GPS antennas which are mounted into vehicles, it is not possible to continually reposition the antenna. Thus, in many vehicular mounted systems, as the vehicle goes up and down hills for example, the alignment between the antenna and the earth is lost, degrading the performance of the GPS receiver.

Thus, there is a continuing need for a GPS antenna which maintains its alignment with the earth's surface.

SUMMARY

In accordance with one aspect, a self-aligning GPS antenna includes a GPS antenna and a container for the antenna. The container is adapted to float within a reservoir.

DETAILED DESCRIPTION

Figure 1:
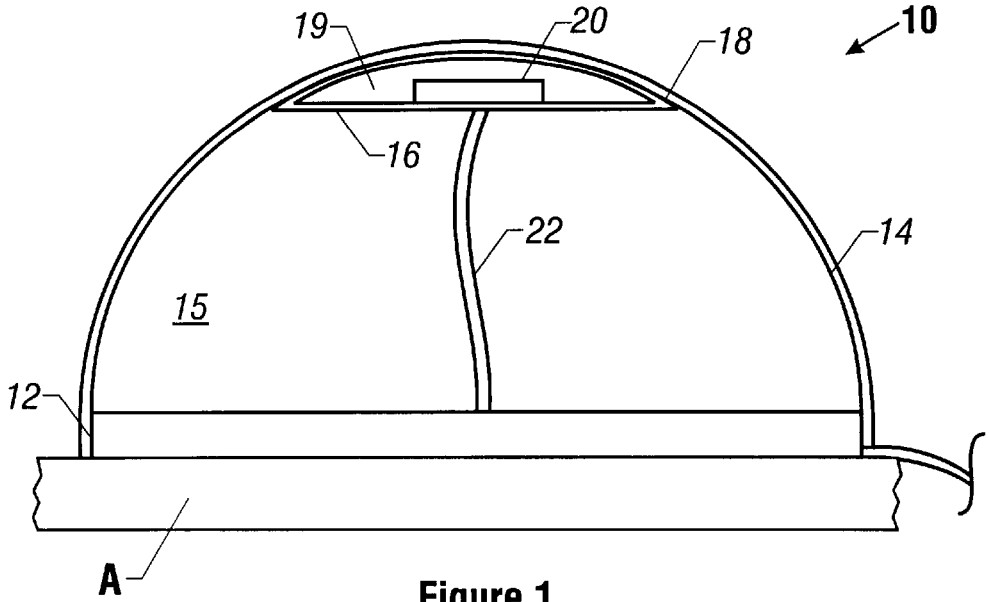
FIG. 1 is a cross-sectional view of one embodiment of the present invention.

Referring to FIG. 1, a GPS antenna 10 includes a mounting base 12 which may be utilized to secure the antenna 10 to a variety of objects. In some embodiments, the GPS antenna 10 may be secured to a motor vehicle. Attached to the base 12 is a spherical reservoir such as the hemispherical unit 14. The unit 14 contains a fluid 15 and the unit 14 may be transparent. A container such as the housing 16 which has a surface 17 whose shape matches the inside spherical shape of the unit 14 is adapted to float in the fluid 15. Namely, the specific gravity of the fluid 19 inside the housing 16 (typically air) is lower then the specific gravity of the fluid 15 (e.g., water) so that the housing 16 floats within the unit 14. The housing 16 may contain a GPS active element 20 for implementing the antenna for a GPS receiver. The housing 16 may be tethered to the base 12 by an electrical cable 22 which provides for electrical communication between the active element 20 and the GPS receiver (not shown).

Figure 2:
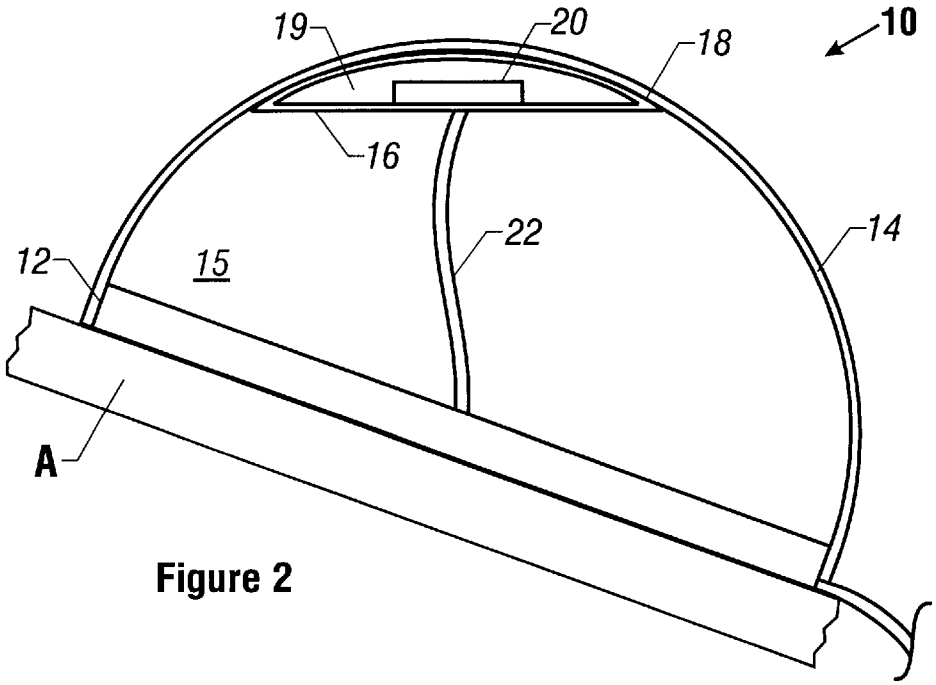
FIG. 2 is a view corresponding to FIG. 1, when the device has been tilted.
Figure 3:
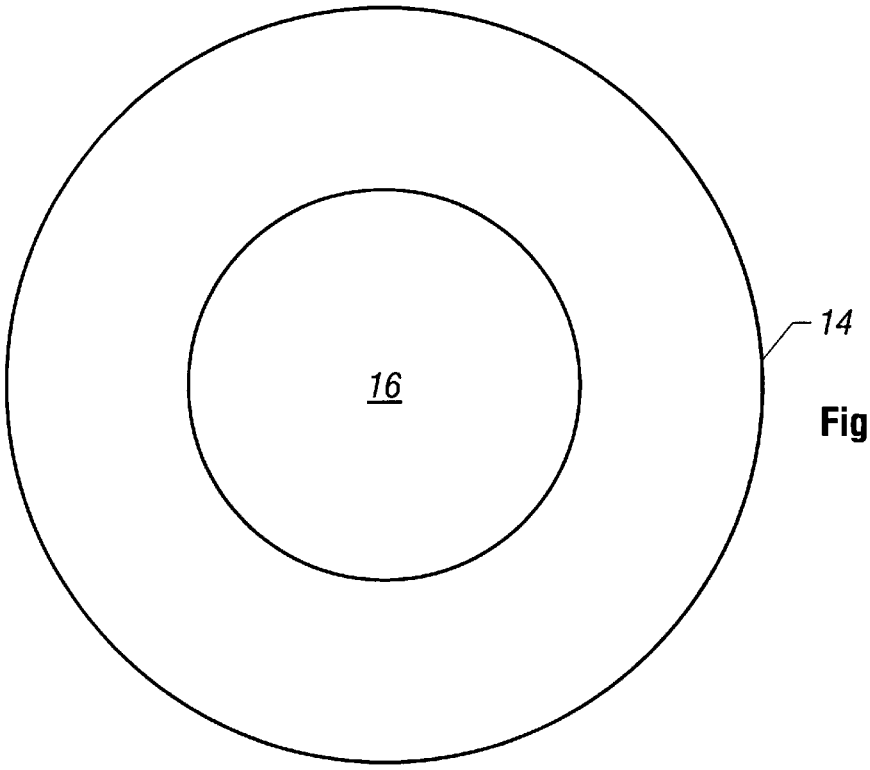
FIG. 3 is a top plan view of the device of FIG. 1.

When the object A, to which the GPS antenna 10 is attached, is tilted, the unit 14 is likewise tilted. However the housing 16 self-levels and aligns with the earth's surface as indicated in FIG. 2. This is because the housing 16 in effect floats on the fluid 15 inside the unit 14. The specific gravities of the fluids 19 and 15 are chosen to allow the housing 16 to have sufficient buoyancy to float while preventing the housing 16 from being too firmly pressed into the inside surface of the unit 14. To do so would limit the ability of the housing 16 to move along the inside surface of the unit 14. In addition, the density or specific gravity of the fluid 15 may be chosen to dampen the movements of the housing 16.

Assembly of the antenna 10 is relatively straightforward. With the unit 14 inverted, the base 12 with attached cable 22 and housing 16 may be forced into the unit 14 already filled with fluid 15. The base 12 may then be secured to the unit 14, for example by a threaded connection between the two. Namely, the base 12 may be rotated to thread the base into threads on the unit 14. The unit 14 may include an o-ring 24 for sealing the connection between the base and the unit 14. As the base tightens on the unit 14, excess fluid is vented so that a reasonably air free enclosure is created.

Figure 4:
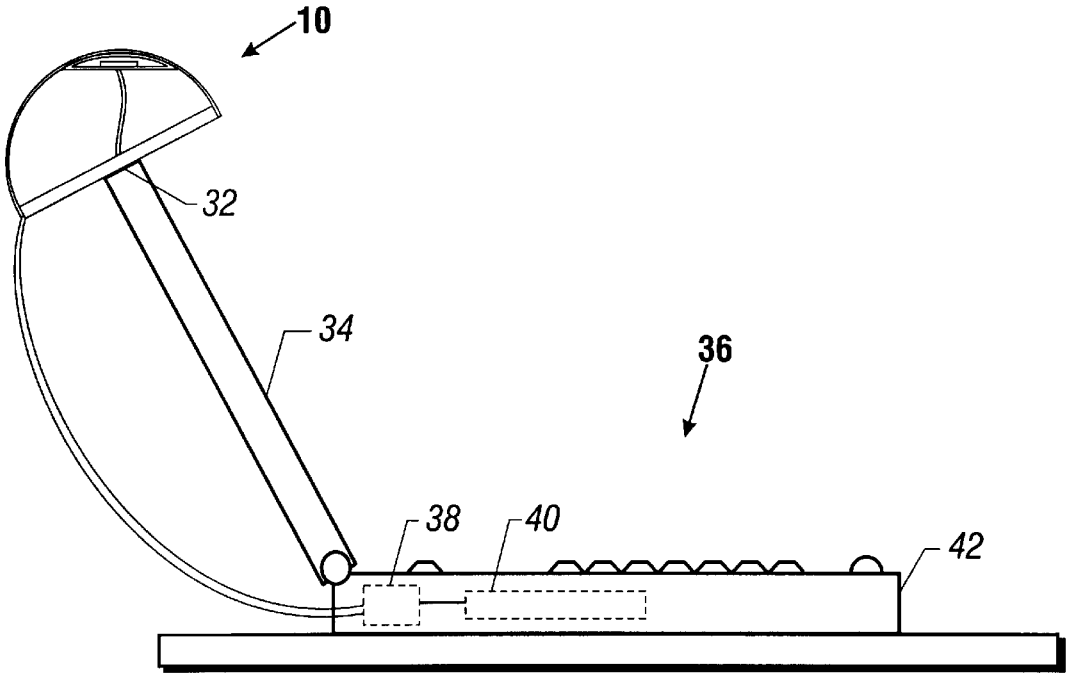
FIG. 4 is a side elevational view of the device shown in FIG. 1 attached on top of the display screen of a laptop or portable computer.

Referring now to FIG. 4, the antenna 10 may be secured to the free edge 32 of the display screen 34 of a laptop computer 36. In this way, as the screen 34 is tilted by the user either to initiate operation or to get the best viewing angle, the antenna 10 automatically self-levels to maintain its parallel alignment with the earth's surface.

The cable 22 may be secured to the appropriate ports on the laptop computer. The cable 22 is coupled to a GPS receiver 38 which in turn is coupled to a processor 40 inside a housing 42.

Embodiments of the present invention advantageously enable a GPS antenna to maintain its alignment with the earth's surface in an economical fashion. Moreover the self-alignment is achieved with a relatively failsafe design.

While the present invention has been described with respect to a limited number of embodiments, those skilled in the art will appreciate numerous modifications and variations therefrom. It is intended that the appended claims cover all such modifications and variations as fall within the true spirit and scope of the present invention.

What is claimed is:

1. A self-aligning global positioning system antenna comprising:

a global positioning system active element;

a container for said element; and a portable fluid reservoir, said container floating in the reservoir such that said element is maintained in a substantially level orientation to the earth.

2. The antenna of claim 1 wherein said reservoir and said container have spherical surfaces.

3. The antenna of claim 2 wherein said reservoir is hemispherical.

4. The antenna of claim 1 wherein said reservoir is filled with liquid and said container is filled with a gas.

5. The antenna of claim 1 wherein said reservoir is transparent.

6. The antenna of claim 1 wherein said container is sealed.

7. A computer system comprising:

a processor;

a housing containing said processor;

a display coupled to said processor;

a global positioning system receiver coupled to said processor;

a self-leveling global positioning system antenna coupled to said receiver; and a container and a portable reservoir, said antenna contained in said container, said container floating in said reservoir.

8. The system of claim 7 wherein said antenna includes an element floating in a reservoir.

9. The system of claim 8 wherein said reservoir is filled with liquid and said element is contained in a sealed housing.

10. The system of claim 9 wherein said housing and said reservoir have spherical surfaces.

11. The system of claim 10 wherein said antenna is mounted on said display.

12. The system of claim 11 wherein said display is tiltable.

13. The system of claim 8 wherein said reservoir is transparent.

14. The system of claim 13 wherein said housing is sealed.

* * * * *